United States Patent [19]

Anderson

[11] Patent Number: 4,681,991

[45] Date of Patent: Jul. 21, 1987

[54] VIBRATING SENSING DEVICE

[75] Inventor: Francis J. Anderson, Foxrock, Co. Dublin, Ireland

[73] Assignee: Anderson Research and Development Limited, Ireland

[21] Appl. No.: 828,125

[22] Filed: Feb. 11, 1986

[30] Foreign Application Priority Data

Feb. 11, 1985 [IE] Ireland ..... 322/85

[51] Int. Cl.[4] ..... H01H 35/14

[52] U.S. Cl. ..... 200/61.45 R; 200/61.52

[58] Field of Search ..... 200/61.45 R–61.53, 200/277, DIG. 2

[56] References Cited

U.S. PATENT DOCUMENTS

| | | | |
|---|---|---|---|
| 3,161,737 | 12/1964 | Hall | 200/61.52 |
| 3,560,680 | 2/1971 | Clarke | 200/61.45 R |
| 4,025,744 | 5/1977 | Kniskern | 200/61.45 R |
| 4,085,304 | 4/1978 | Hasler | 200/61.52 X |
| 4,185,180 | 1/1980 | Anderson | 200/61.52 X |
| 4,467,153 | 8/1984 | Jones et al. | 200/61.45 R |

FOREIGN PATENT DOCUMENTS

| | | | |
|---|---|---|---|
| 0001154 | 3/1979 | European Pat. Off. . | |
| 1005217 | 9/1965 | United Kingdom . | |
| 1524081 | 9/1978 | United Kingdom | 200/61.45 R |
| 2058460 | 8/1979 | United Kingdom . | |
| 2077504 | 12/1981 | United Kingdom | 200/61.45 R |

*Primary Examiner*—J. R. Scott

*Attorney, Agent, or Firm*—Sughrue, Mion, Zinn, Macpeak and Seas

[57] ABSTRACT

The invention provides a vibration sensing device which is used in safety and security equipment. Such devices comprise a main inertia mass on a support assembly to form an electrical switch which in turn is part of an electrical monitoring circuit. The support assembly includes at least two stationary space-apart electrically conductive and mutually electrically insulated supports. The invention provides more than one main inertia mass and an additional inertia mass supported by at least a pair of main inertia masses. On sensing vibration all the inertia masses will resonate, the provision of the additional inertia mass increasing the number of electrical paths through which current can flow. For example, if there are first and second main inertia masses and an additional inertia mass, a signal, in addition to being transmitted across one main inertia mass from one support to the other can also be delivered from one support, through the first main mass, the additional inertia mass and the second main mass to the other support. There are thus four electrical paths where before without the additional inertia mass there were two.

34 Claims, 16 Drawing Figures

VIBRATING SENSING DEVICE

BACKGROUND OF THE INVENTION

Introduction

The present invention relates to a vibration sensing device for use in many operations such as for security or safety equipment. The present invention is particularly related to vibration sensing devices of the type comprising an inertia mass on a support assembly which includes an electrical monitoring circuit closed by the inertia mass on the support assembly.

Vibration sensing devices, often called inertia sensing devices or accelerometers are used extensively for mamy operations. For example, they are used for security equipment and for safety equipment. These vibration sensing devices are switches operated by movement of the switch as a whole under the influence of an accelerating force, for example, any vibration, impact or other accelerating force.

Such vibration sensing devices may be used on machines to ensure that the machines are cut out once they exceed a predetermined amplitude of oscillation due to some over or eccentric loading. Similarly they may be used on vehicles in the event of a crash or of unauthorised interference.

In security equipment they are used for detecting vibrations in a window or door caused by an intruder in the building or by an attempted break-in.

Briefly, such vibration sensing devices when used in a security system consist primarily of two elements, a detecting loop namely, the sensor or vibration sensing device and an analysing circuit. Such devices, for example, are well known as shown in British Pat. No. 1,263,076 which describes a particular vibration sensing device and British Pat. No. 1,441,563 which describes a particular analysing circuit. Similarly, my previous U.S. Pat. No. 4,185,180 describes a vibration sensing device which includes a pair of spaced-apart electrically conductive plates each having an annular track formed by a hole. An electrically conducted bar is mounted between the plates on the tracks. On sensing vibration the bar will resonate, lifting off the tracks, thus making and breaking the electrical circuit between the plates.

FIELD OF THE INVENTION

One of the major problems with these and other vibration sensing devices is the possibility of false alarms being registered. It has been found with vibration sensing devices known heretofore that a build-up of an oxide on the contacting surfaces of such devices causes an electrical barrier between the contacting members i.e. between the inertia mass and the supports since the oxide is an insulator. Various ingenious suggestions and methods have been used to prevent the build-up of such an oxide. Unfortunately, they have heretofore been rather unsatisfactory.

A particular advantage to the vibration sensing device described in my U.S. Pat. No. 4,185,180 is that it can be placed in many orientations relative to the surface on which the vibration sensing device is placed. It is desirable that as far as possible a vibration sensing device should have this feature.

Additionally, a problem with known vibration sensing devices is that it is relatively difficult to alter the response of the device without using some form of magnetic damping which is not desirable in that it can be readily easily tampered with by the placing of a magnet adjacent the device. The response may also be altered by changing the configuration of the device which means that in use or on installation the response cannot be varied.

It has long been appreciated that one of the major problems with vibration sensing devices is the necessity to apply high contact pressures. Many of the known vibration sensing devices do not do this.

OBJECTS

The present invention is directed towards providing a vibration sensing device which will be more efficient in use than those heretofore produced.

Another object of the invention is to provide a vibration sensing device in which the build-up of an oxide on the contacting surfaces will be as far as possible prevented and when present will be nullified.

Another object of the invention is to provide a vibration sensing device that can be mounted on any surface without the necessity for alterations in the device.

A still further object of the present invention is to provide a vibration sensing device that may be readily easily manufactured.

An additional object of the present invention is to provide a vibration sensing device the sensitivity of which can be readily altered.

Again an object of the present invention is to provide a vibration sensing device in which high contact pressures are present between the inertia mass and the support assembly.

SUMMARY OF THE INVENTION

The invention provides a vibration sensing device comprising a non-conductive base support member: at least two spaced-apart electrically conductive and mutually electrically insulated supports forming a support assembly on the base support member; a plurality of electrically conductive main inertia masses on the support assembly; and an electrically conductive additional inertia mass supported by at least two main inertia masses, the said inertia masses and support assembly forming part of an electrical monitoring circuit.

The above and other objects and advantages of this invention will become apparent from the following detailed description in connection with the accompanying drawings.

DETAILED DESCRIPTION OF THE INVENTION

Figure 1:
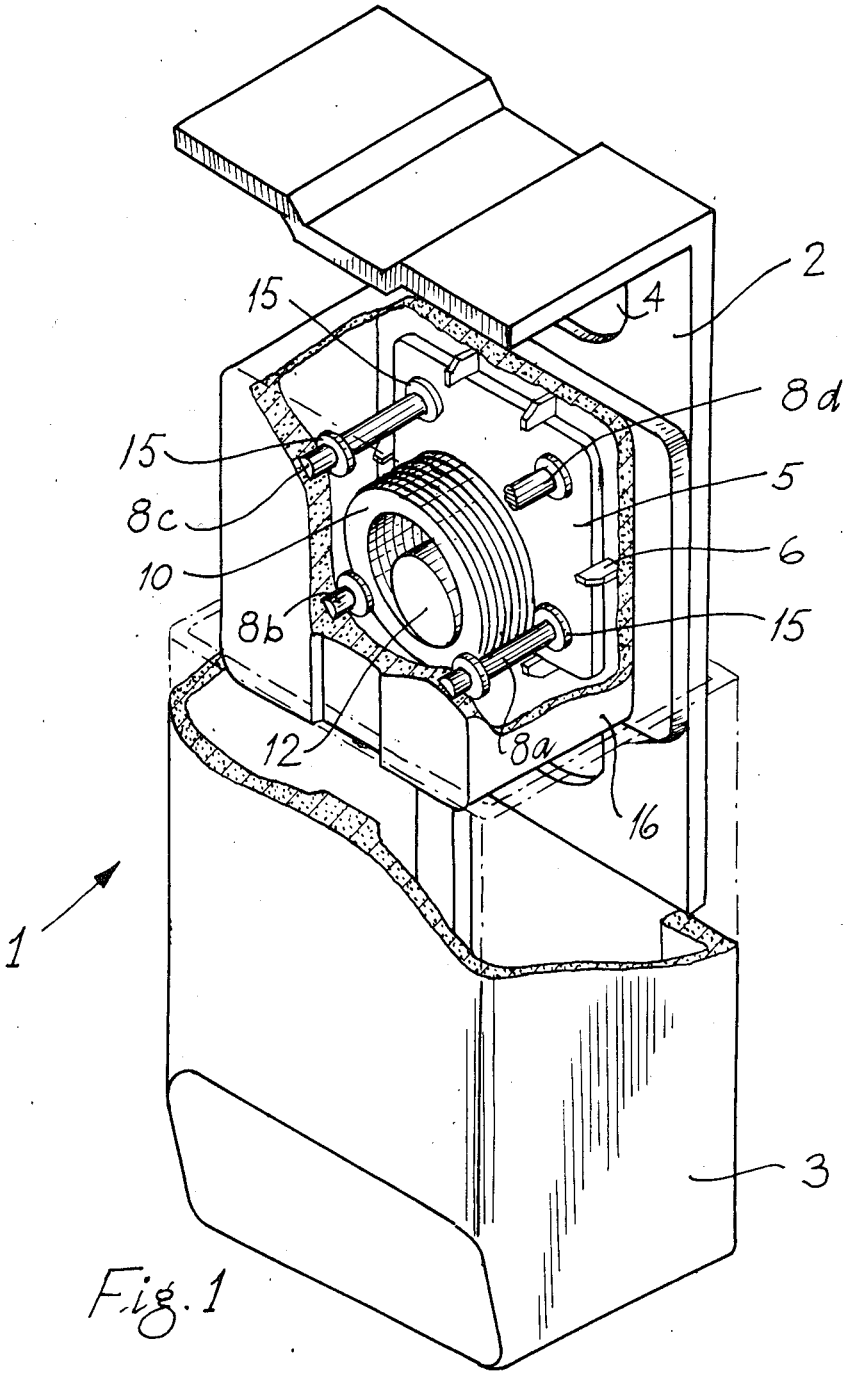
FIG. 1 is a cut-away perspective view of a vibration sensing device according to the invention.
Figure 2:
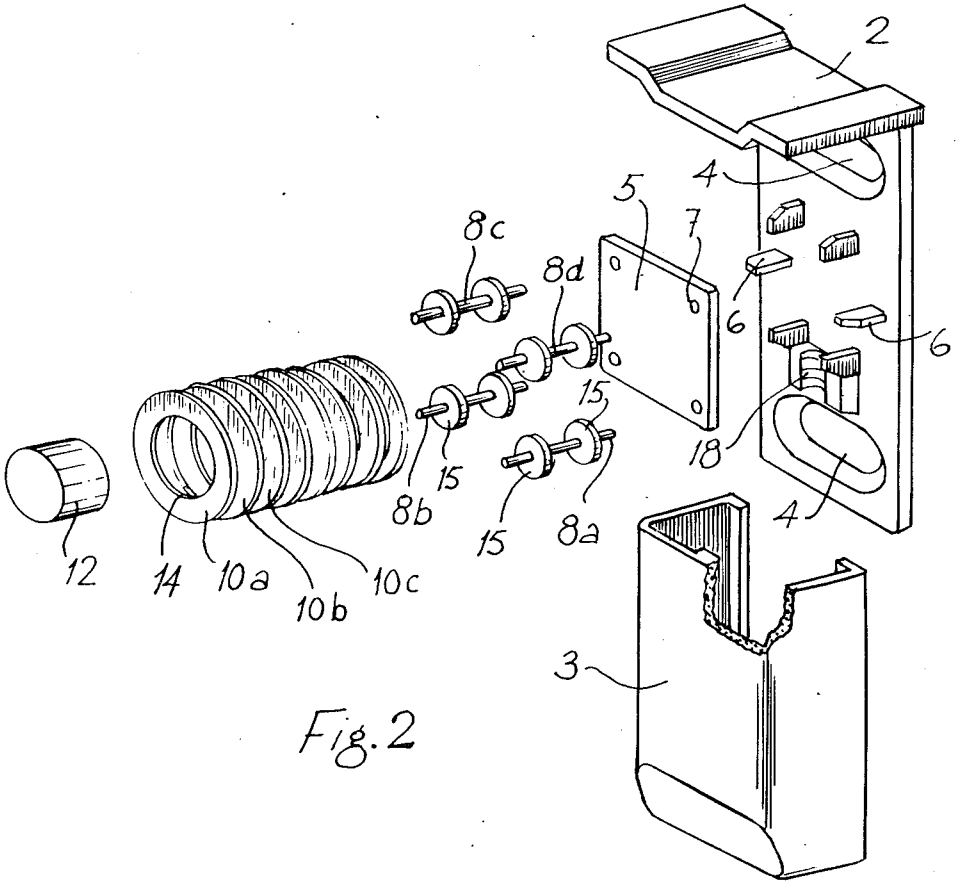
FIG. 2 is an exploded view of the vibration sensing device of FIG. 1.
Figure 3:
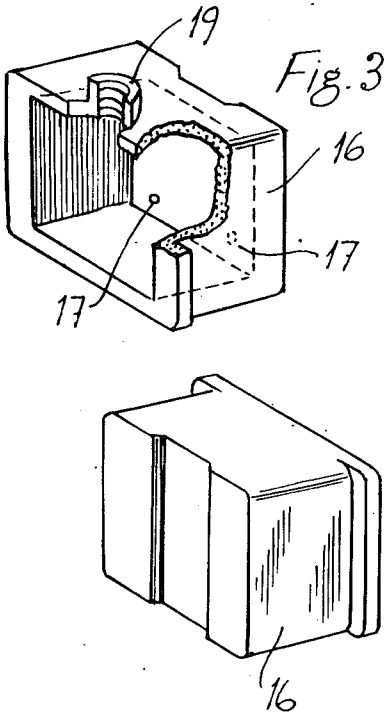
FIG. 3 is a perspective view of a detail of the device of FIG. 1.

Referring to the drawings and initially to FIGS. 1 to 3 inclusive there is provided a vibration sensing device according to the invention, indicated generally by the reference numeral 1. The device 1 comprises a non-conductive base support member including a housing having a base member 2 and a cover 3 engagable with the base member 2, both of plastics material. Slots 4 in the base member 2 are provided for securing the device to a window, door or the like. A base plate 5 of plastics material is mounted on and retained spaced-apart from the base member 2 by spacers 6 of plastics material moulded integrally with the base 2. Holes 7 in the base plate 5 mount a support assembly formed from four electrically conductive support bars 8*a*, 8*b*, 8*c* and 8*d*, in this embodiment of the invention, of gold plated brass. Main inertia masses, in this case discs in the form of eight washers 10 each having an inner hole 14 are mounted on the support bars 8*c* and 8*d*. Certain individual washers 10 are differentiated by the use of subscript letters a, b and c. At any one time, depending on the orientation of the device 1, the washers 10 are mounted on two support bars only. The washers 10 are of gold-plated brass and thus electrically conductive. The washers 10 close an electrical circuit between the pair of support bars 8*c* and 8*d* on which they rest. To further increase the electrical conductivity of the washers between the support bars, an additional inertia mass, in this embodiment an inertia bar 12, also of gold plated brass, rests on the inner holes 14 of the washers 12. Stops 15 on the support bars, 8*a*, 8*b*, 8*c* and 8*d* retain as necessary the washers upright on the bars 8*a*–8*d*. An inner cover 16 with holes 17 receive the other ends of the support bars 8*a*–8*d*. The cover 16, also of plastics material, is press-fit over the spacers 6.

Two halves 18 and 19 of a cable clamp are moulded into the base 2 and the inner cover 16 respectively. Cables (not shown) are connected to the two support members 8*a* and 8*b* and the support bars 8*c* and 8*d* are respectively connected to the bars 8*a* and 8*b*. Therefore, irrespective of the orientation of the device, the washers 10 always close a circuit between the two wires of the cable.

In use, the device is mounted on a window, door or the like with the washers in an upright position. Thus, it will be appreciated that for the device to operate efficiently, it may be mounted in any of four orientations at 90° to each other. When the device is subjected to vibrations, for example, in an attempted break-in, by an intruder chiselling putty from a glass or picking a lock or the like, the bar 12 and washers 10 vibrate relative to the support bars 8*a*–8*d*, thus opening and closing the electrical circuit. These vibrations are then subsequently monitored in an appropriate monitoring apparatus.

A particular advantage of the invention is that by virtue of the fact that the bar 12 rests on the inner bores of the washers 10, the possibility of false alarms being registered, is considerably reduced. It will be appreciated that if a build-up of oxide occurs in any of the contact points between any of the washers 10 and the support bars 8*a*–8*d*, the bar 12, acting as a conductor between the washers, will overcome this problem. For example, if a build-up of oxide causes contact to break down between the washer 10(*a*) and the support 8(*b*), then on the assumption that at least one of the other washers makes electrical contact with the bar 8(*b*), the bar 12 will conduct between the washer 8(*a*) and the relevant washer or washers making electrical contact with the support bar 8(*b*). The eight washers effectively provide eight contact paths through which current can flow. That of course, presumes all washers make effective electrical contact with their respective supports. Further, by virtue of the fact that the second, additional inertia mass 12 rests on the washers, there are eight paths through which the current can flow from the support 8(*b*) through the washer 10(*a*) onto the support 8(*a*). The same applies to all eight washers. By virtue of having the second, additional inertia mass 12, there is a multipler effect so that there are sixty four ($8\times8$) paths through which current can flow. Further, there is high contact pressure due to the use of the additional inertia mass.

Figure 4:
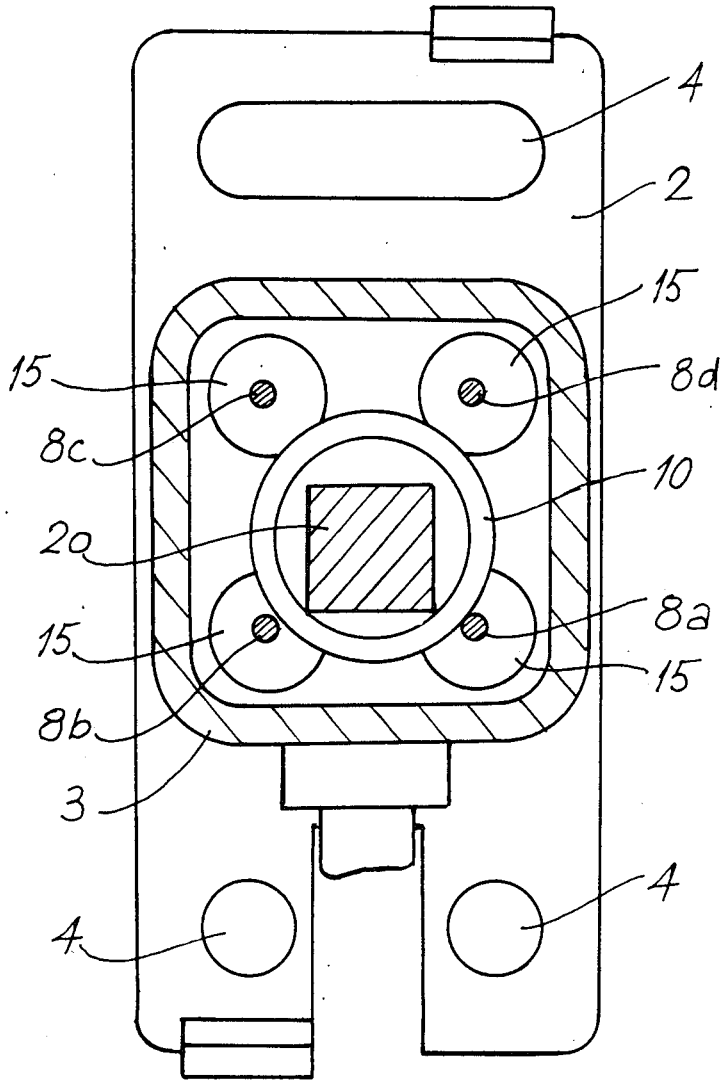
FIG. 4 is a cross-sectional view of an alternative construction of vibration sensing devices according to the invention.

Referring now to FIG. 4 there is illustrated a vibration sensing device according to another embodiment of the invention. This device is substantially similar to that described with reference to FIGS. 1 to 3, and similar components are identified by the same reference numerals. The essential difference between this device and that of the device of FIGS. 1 to 3, is that the additional inertia mass in this case is provided by a bar 20 of square cross-section section. The advantage of this is that since the corners of the bar 20 rest on the inner edge of the washer 10 they act on the inner edges of the washer 10 with a type of wiping action, thereby cleaning off any deposits of oxide which may build up. This further improves the sensitivity of the device.

A second difference between this device and that already described, is that the spacing between the bars 8(*a*) and 8(*b*) and 8(*c*) and 8(*d*), is less than the spacing between the bars 8(*b*) and 8(*c*), and 8(*a*) and 8(*d*). This, therefore, allows the device to be mounted in four positions, as is the case of the previous device but it has the added advantage that in two positions the response from the device is different to the response when mounted in the other two positions. When the device is mounted with the washers supported on the bars 8(*a*) and 8(*b*), the device has a particular sensitivity. However, when the washers are supported between the bars 8(*b*) and 8(*c*), the washers are supported at a higher level, and therefore, the device is damped relative to the previous position just described, and accordingly, the sensitivity is slightly reduced. Similarly, the response by supporting the washers on 8(*c*) and 8(*d*), will be similar to the response for 8(*a*) and 8(*b*), and also the response when the washers are supported between 8(*a*) and 8(*d*) will be similar to the response when the washers are supported between the supports 8(*b*) and 8(*c*).

It will also be noticed in this embodiment of the invention that the width of the washers in this device is slightly less than the width of the washers in the device of FIGS. 1 to 3.

The above are two embodiments of vibration sensing devices which are particularly appropriate according to the present invention. However, it will be appreciated that there are many other ways in which the invention can be carried out and the following description with relation to the accompanying diagrammatic sketches FIGS. 5 to 16 illustrates some of these. Obviously, many other variations and combinations of the features disclosed can be devised.

Figure 5:
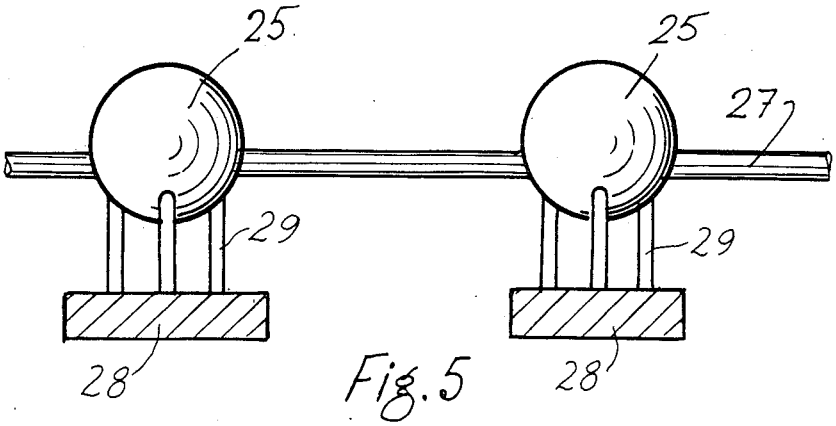
FIG. 5 is a side schematic view of another embodiment of the invention.
Figure 6:
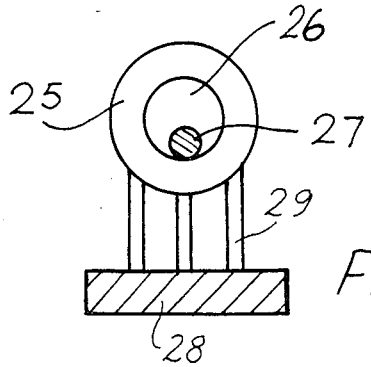
FIG. 6 is an end view of the embodiment of FIG. 5.

Referring to FIGS. 5 and 6 there is illustrated a vibration sensing device which is an improvement of the type such as described in British Pat. No. 1,263,076 in which an electrically conductive sphere is supported on a support assembly in this case forming a support sub-assembly of three pins 29 on a support 28. Thus, there are two separate main inertia masses formed from spheres 25 each having straight through holes 26 to accommodate an additional inertia mass in this case, a round bar 27. More spheres and associated support assemblies may be used.

Figure 7:
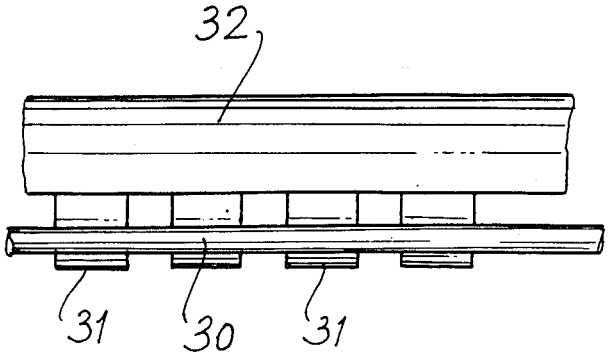
FIG. 7 is a side schematic view of a still further embodiment of the invention.
Figure 8:
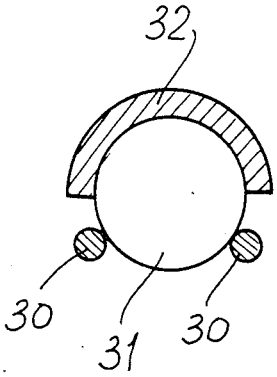
FIG. 8 is an end view of the embodiment of FIG. 7, and FIGS. 9 to 16 are other end views of further schematic diagrams showing alternative embodiments of the invention.

Referring to FIGS. 7 and 8 there is illustrated a vibration sensing device formed from two spaced-apart bars 30 on which are mounted a plurality of discs in this case short solid bars 31. An additional inertia mass 32 of arcuate shape rests on the bars 31.

Figure 10:
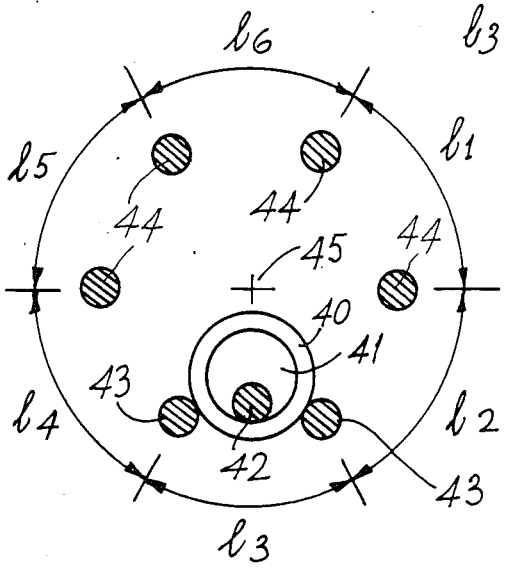
Figure 9:
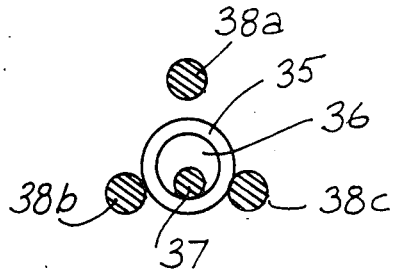

In FIG. 9 there is illustrated an inertia mass formed from a circular disc 35 having a hole 36 in which is mounted an additional inertia mass formed from a bar 37. In this embodiment there are three support bars 38*a*, 38*b* and 38*c*. If, for example, it is presumed that the support bars 38*a* and 38*b* are electrically connected i.e. of the same polarity then the vibration sensing device will work when the support bars 38*b* and 38*c* are horizontal or when the support bars 38*a* and 38*c* are horizontal but will obviously not work when the support bar 38*c* is uppermost. It will be seen that generally speaking it will be advantageous to have an even number of support bars. Referring to FIG. 10 there is illustrated a vibration sensing device in which there is a plurality of circular discs 40 with each having a hole 41 and supporting an additional inertia mass formed from a bar 42. The discs 40 are mounted on two support bars 43 which are part of a support assembly which has a number of additional support bars 44. These additional support bars 44 on rotation of the assembly about its longitudinal axis (in FIG. 10 into the plane of the paper and indicated by the reference numeral 45) can be used as required. It will be noted that these additional support bars are so arranged when not in use as to be spaced-apart from the main inertia masses, in this case, the discs 40. The spacing between the various support bars is identified by the letter "l" and subscripts 1 to 6. It will be noted that:

$$l_1=l_2=l_3=l_4=l_5=l_6$$

Figure 11:
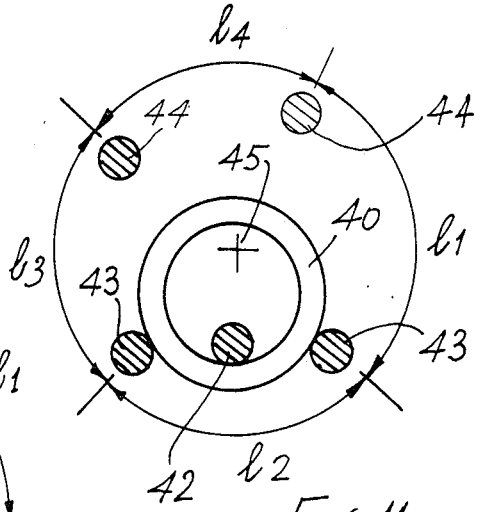

Referring to FIG. 11 there is illustrated a variation on the embodiment described with reference to FIG. 10 and parts are identified by the same reference numerals. In this embodiment there are only two support bars 43 and two additional support bars 44. In this embodiment:

$$l_1>l_2>l_3>l_4$$

Figure 12:
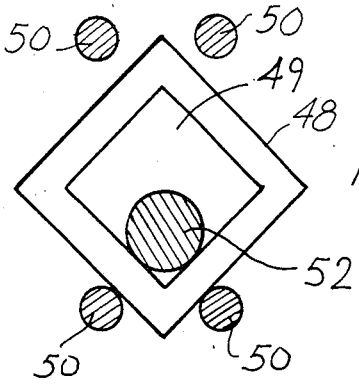

Referring to FIG. 12 there is illustrated a still further construction of disc 48 of square cross-section having a square hole 49 and mounted on support bars 50. It has an additional inertia mass 52.

Heretofore all the embodiments described have shown the inertia masses mounted on the support bars. Needless to say, it will be appreciated that where the inertia masses have a straight-through hole that they can be mounted not on the support bars but by the support bars projecting through the holes.

Figure 13:
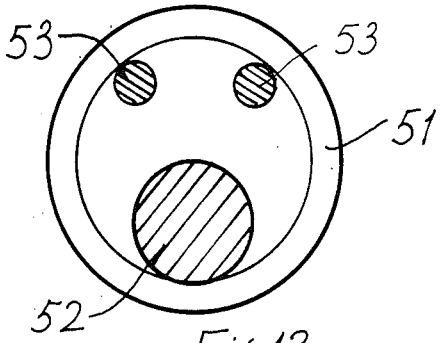
Figure 15:
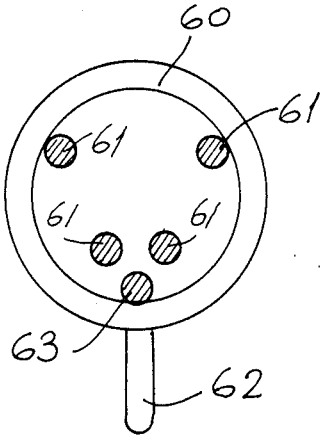
Figure 16:
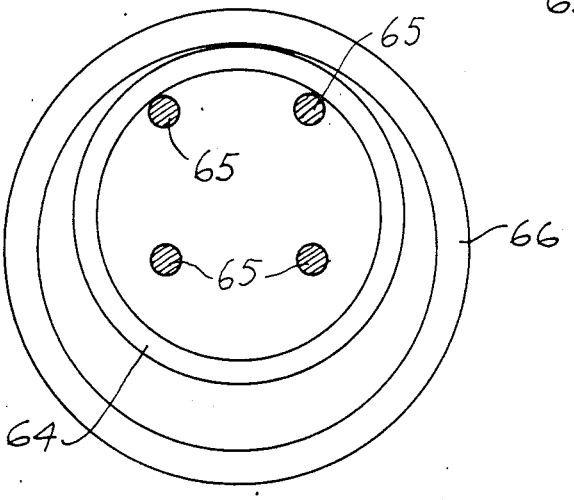
Figure 14:
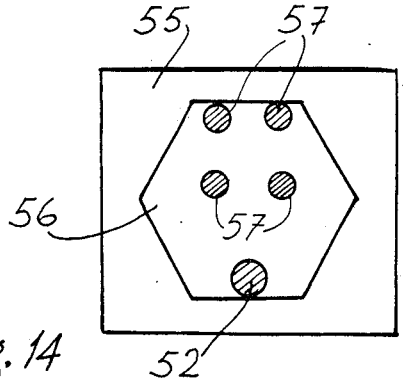

Referring to FIG. 13 there is illustrated discs 51 in the shape of a washer having mounted within it an additional inertia mass formed from the bar 52. Each disc 51 is suspended from support bars 53. FIG. 14 illustrates a construction of disc 55 which is square and has a six sided hole 56 which again embraces support bars 57. FIG. 15 shows another construction of vibration sensing device formed from a plurality of discs 60 in the form of washers mounted on support bars 61 and having an additional inertia mass formed by a pendulum 62 suspended from a bar 63 which bridges the discs 60. In FIG. 16 there is illustrated a further disc 64 mounted on support bars 65 and having an additional inertia mass formed from a tubular member 66.

It will be relatively easy for those skilled in the art to work out other different variations on the embodiment described above, for example, it will be appreciated that instead of support bars any other form of support may be used such as but not exclusively the support assembly of FIGS. 5 and 6.

It will also be appreciated that the use of additional inertia masses of different weights will allow the response of the vibration sensing device to be varied thus leading to economics in manufacture.

I claim:

1. A vibration sensing device comprising:

a non-conductive base support member;

at least two spaced-apart electrically conductive and mutually electrically insulated supports forming a support assembly and mounted on the base support member;

a plurality of electrically conductive main inertia masses supported by and in electrical contact with the support assembly so as to form a first set of electrical connections which may be broken by vibration; and an electrically conductive additional inertia mass supported by and in electrical contact with at least two of the main inertia masses so as to form a second set of electrical connections which may be broken by vibration, said main and additional inertia masses and support assembly forming part of an electrical monitoring circuit.

2. A vibration sensing device as recited in claim 1 in which each main inertia mass has a straight through hole forming an annular track and the additional inertia mass is fitted through each said straight through hole, the cross-sectional area of the additional inertia mass relative to each said straight hole being such as to permit movement of the additional inertia mass off the annular track on vibration of the device.

3. A vibration sensing device as recited in claim 2 in which the support assembly comprises a pair of spaced-apart supports, the main inertia masses being arranged side by side on the supports.

4. A vibration sensing device as recited in claim 3 in which the spaced-apart supports comprise a first pair of spaced-apart support bars parallel to a longitudinal axis.

5. A vibration sensing device as recited in claim 4 in which the support assembly further includes additional support bars to provide support at different mounting positions of the support assembly on rotation of the assembly about its longitudinal axis, said additional support bars being so arranged when not in use as to be spaced-apart from the main and additional inertia masses to permit movement of the main and additional inertia masses on vibration of the device.

6. A vibration sensing device as recited in claim 4 further including at least a third support bar parallel to said pair of spaced-apart support bars in which all of the support bars are at the same radial distance from and equi-spaced around the longitudinal axis.

7. A vibration sensing device as recited in claim 4 further including at least a third support bar parallel to said pair of spaced-apart support bars in which all of the support bars are at the same radial distance from the longitudinal axis and all of the circumferential distances between sequential ones of said support bars and different from each other.

8. A vibration sensing device as recited in claim 4 further including a second pair of spaced-apart support bars parallel to said longitudinal axis, said first and second pairs being arranged to provide a pair of upper support bars and a pair of lower support bars in two parallel planes with the support bars of one of said first and second pairs being mutually spaced-apart a greater distance than are those of the other of said first and second pairs.

9. A vibration sensing device as recited in claim 3 in which the support assembly comprises a pair of spaced supports which pass through each said straight through hole for suspension of each said main inertia mass.

10. A vibration sensing device as recited in claim 9 in which the spaced-apart supports comprise a first pair of spaced-apart support bars parallel to a longitudinal axis.

11. A vibration sensing device as recited in claim 10 in which the support assembly includes additional support bars to provide support at different mounting positions of the support assembly on rotation of the assembly about its longitudinal axis, said additional support bars being so arranged when not is use as to be spaced-apart from the main and additional inertia masses to permit movement of the main and additional inertia masses on vibration of the device.

12. A vibration sensing device as recited in claim 10, further including a second pair of spaced-apart support bars parallel to said longitudinal axis, said first and second pairs being arranged to provide a pair of upper support bars and a pair of lower support bars in two parallel planes with the support bars of one of said first and second pairs being mutually spaced-apart a greater distance than those of the other of said first and second pairs.

13. A vibration sensing device as recited in claim 9 further including at least a third support bar parallel to said pair of spaced-apart support bars in which all of the support bars are at the same radial distance from and equi-spaced around the longitudinal axis.

14. A vibration sensing device as recited in claim 9 further including at least a third support bar parallel to said pair of spaced-apart support bars in which all of the support bars are at the same radial distance from said longitudinal axis and all of the circumferential distances between sequential ones of said spaced-apart support bars are different from each other.

15. A vibration sensing device as recited in claim 2 in which each said main inertia mass is a disc having a pair of substantially flat faces and a circumferential relatively narrow edge.

16. A vibration sensing device as recited in claim 15 in which the disc is a circular disc.

17. A vibration sensing device as recited in claim 15 in which the disc has a multi-sided edge with three or more flat faces.

18. A vibration sensing device as recited in claim 15 in which each annular track is formed by a circular hole.

19. A vibration sensing device as recited in claim 15 in which each annular track is formed by a multi-sided hole.

20. A vibration sensing device as recited in claim 2 in which the additional inertia mass is a bar having at least three flat faces where it rests on each said annular track.

21. A vibration sensing device as recited in claim 2 in which the additional inertia mass is a bar of circular cross-section.

22. A vibration sensing device as recited in claim 21 in which each main inertia mass is a disc having a pair of substantially flat faces and a circumferential relatively narrow edge.

23. A vibration sensing device as recited in claim 22 in which the disc is a circular disc.

24. A vibration sensing device as recited in claim 22 in which the disc has a multi-sided edge with three or more flat faces.

25. A vibration sensing device as recited in claim 22 in which each annular track is formed by a circular hole.

26. A vibration sensing device as recited in claim 22 in which the annular track is formed by a multi-sided hole.

27. A vibration sensing device as recited in claim 1 in which the additional inertia mass rests on the main inertia masses.

28. A vibration sensing device as recited in claim 27 in which the support assembly comprises a pair of spaced-apart supports, the main inertia masses being arranged side by side on the supports.

29. A vibration sensing device as recited in claim 28 in which the spaced-apart supports comprise a pair of spaced-apart support bars parallel to a longitudinal axis.

30. A vibration sensing device as recited in claim 28 in which the support assembly further includes additional support bars to provide support at different mounting positions of the support assembly on rotation of the assembly about its longitudinal axis, said additional support bars being so arranged when not in use as to be spaced-apart from the main and additional inertia masses to permit movement of the main and additional inertia masses on vibration of the device.

31. A vibration sensing device as recited in claim 27 in which each main inertia mass is a disc having a pair of substantially flat faces and a circumferential relatively narrow edge.

32. A vibration sensing device as recited in claim 1 in which the support assembly is formed from at least two separate sub-assemblies each having at least two spaced-apart electrically and mutually electrically insulated supports on the base support member, at least one main inertia mass being supported on each sub-assembly and each main inertia mass having a straight through hole forming an annular track for reception of the additional inertia mass, the cross-sectional area of the additional inertia mass relative to the hole being such as to permit movement of the additional inertia mass off the annular track on vibration of the device.

33. A vibration sensing device as recited in claim 32 in which each main inertia mass is a sphere.

34. A vibration sensing device as recited in claim 32 in which each sub-assembly comprises three upstanding pins forming supports for a sphere.

* * * * *